US010964276B2

(12) United States Patent
Tada et al.

(10) Patent No.: US 10,964,276 B2
(45) Date of Patent: Mar. 30, 2021

(54) DISPLAY APPARATUS, CONTROL METHOD OF DISPLAY APPARATUS, AND NON-TRANSITORY COMPUTER-READABLE MEDIUM

(71) Applicant: CANON KABUSHIKI KAISHA, Tokyo (JP)

(72) Inventors: Mitsuru Tada, Machida (JP); Takeshi Ikeda, Ebina (JP); Yasuo Suzuki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/362,112

(22) Filed: Mar. 22, 2019

(65) Prior Publication Data

US 2019/0295477 A1 Sep. 26, 2019

(30) Foreign Application Priority Data

Mar. 23, 2018 (JP) ..... 2018-056396

(51) Int. Cl.
*G09G 3/34* (2006.01)
*G09G 3/36* (2006.01)

(52) U.S. Cl.
CPC ..... *G09G 3/342* (2013.01); *G09G 3/36* (2013.01); *G09G 2320/0247* (2013.01); *G09G 2320/0646* (2013.01); *G09G 2320/0686* (2013.01); *G09G 2320/103* (2013.01)

(58) Field of Classification Search
None
See application file for complete search history.

(56) References Cited

U.S. PATENT DOCUMENTS

2005/0248524 A1* 11/2005 Feng ..... G09G 3/3413 345/102
2006/0146003 A1* 7/2006 Diefenbaugh ..... G09G 3/3406 345/102
2019/0027089 A1* 1/2019 Moribe ..... H01L 33/00

FOREIGN PATENT DOCUMENTS

JP 2014-098890 A 5/2014
JP 2015-049487 A 3/2015
JP 2015-148826 A 8/2015
JP PCT/2016072858 * 8/2016
JP 2018-045140 A 3/2018

* cited by examiner

*Primary Examiner* — Ifedayo B Iluyomade
(74) *Attorney, Agent, or Firm* — Cowan, Liebowitz & Latman, P.C.

(57) ABSTRACT

A display apparatus includes: a light emission unit including a plurality of light sources that emit light; a display unit displays an image by modulating the light on the basis of frames; a determination unit determines a luminescence intensity of each of the light sources for each sub-frame; and a control unit controls lighting of each of the light sources for each sub-frame at the luminescence intensity, wherein the determination unit (1) determines a leakage light quantity, wherein the leakage light quantity is a transmission quantity of light from other light sources that is generated due to response delay in modulation by the display unit, for each region of the display unit corresponding to each of the light sources, and (2) determines the luminescence intensity in accordance with the difference of the leakage light quantity between the regions.

18 Claims, 14 Drawing Sheets

FIG.3

LIGHT SOURCE LIGHTING PHASE INFORMATION TA

| | | NUMBER OF TIMES OF LIGHT EMISSION IN SUB-FRAME | |
|---|---|---|---|
| | | 1 | 2 |
| CONTROL AREA NUMBER | (0,0) | 0.5 | 1.0 |
| | (1,0) | 1.0 | 1.5 |

LIGHTING TIMING

FIG.4

RESPONSIVENESS TABLE DATA
(RESPONSE INFORMATION TBL 105)

| | | PREVIOUS FRAME DATA (SIGNAL GRADATION) | | | | | | | | |
|---|---|---|---|---|---|---|---|---|---|---|
| | | 0 | 1 | ··· | 64 | ··· | 128 | ··· | 254 | 255 |
| CURRENT FRAME DATA (SIGNAL GRADATION) | 0 | 0 | 0.90 | ··· | 0.50 | ··· | 0.50 | ··· | 0.80 | 0.78 |
| | 1 | 0.85 | 0 | ··· | 0.50 | ··· | 0.50 | ··· | 0.78 | 0.77 |
| | ⋮ | ⋮ | ⋮ | ⋮ | ⋮ | ⋮ | ⋮ | ⋮ | ⋮ | ⋮ |
| | 64 | 0.50 | 0.50 | ··· | 0 | ··· | 0.50 | ··· | 0.50 | 0.50 |
| | ⋮ | ⋮ | ⋮ | ⋮ | ⋮ | ⋮ | ⋮ | ⋮ | ⋮ | ⋮ |
| | 128 | 0.50 | 0.50 | ··· | 0.50 | ··· | 0 | ··· | 0.50 | 0.50 |
| | ⋮ | ⋮ | ⋮ | ⋮ | ⋮ | ⋮ | ⋮ | ⋮ | ⋮ | ⋮ |
| | 254 | 0.51 | 0.54 | ··· | ··· | ··· | ··· | ··· | 0 | 0.90 |
| | 255 | 0.50 | 0.52 | ··· | ··· | ··· | ··· | ··· | 0.90 | 0 |

FIG.14A

CONTROL GAIN TABLE DATA STRUCTURE

SIGNAL GRADATION

CONTROL GAIN VALUE

| SUB-FRAME SN=1 | PREVIOUS FRAME DATA | | | | |
|---|---|---|---|---|---|
| | 0 | 1 | ... | 254 | 255 |
| CURRENT FRAME DATA (SIGNAL GRADATION) | 0 | 0.00 | ... | 0.00 | 0 |
| | 1 | 0.00 | 0 | 0.00 | 0.00 |
| | ⋮ | ⋮ | ⋮ | ⋮ | ⋮ |
| | 254 | 0.00 | 0.00 | ... | 0 | 0.00 |
| | 255 | 0.00 | 0.00 | ... | 0.00 | 0 |

SIGNAL GRADATION

FIG.14B

CONTROL GAIN TABLE DATA STRUCTURE

SIGNAL GRADATION

CONTROL GAIN VALUE

| SUB-FRAME SN=2 | PREVIOUS FRAME DATA | | | | |
|---|---|---|---|---|---|
| | 0 | 1 | ... | 254 | 255 |
| CURRENT FRAME DATA (SIGNAL GRADATION) | 0 | 0 | 1.00 | ... | 1.00 | 1.00 |
| | 1 | 1.00 | 0 | ... | 1.00 | 1.00 |
| | ⋮ | ⋮ | ⋮ | ⋮ | ⋮ | ⋮ |
| | 254 | 1.00 | 1.00 | ... | 0 | 1.00 |
| | 255 | 1.00 | 1.00 | ... | 1.00 | 0 |

SIGNAL GRADATION

DISPLAY APPARATUS, CONTROL METHOD OF DISPLAY APPARATUS, AND NON-TRANSITORY COMPUTER-READABLE MEDIUM

BACKGROUND OF THE INVENTION

Field of the Invention

The present invention relates to a display apparatus, a control method of the display apparatus, and a non-transitory computer-readable medium.

Description of the Related Art

As a method for implementing a high contrast display in a liquid crystal display, a local dimming (LD) control technique, which modulates the brightness of the light source in-plane in accordance with a video signal, is available. A global dimming (GD) control technique, which modulates the brightness of the light source on the entire screen in accordance with the video signal, is also available.

Normally in a liquid crystal display, the gradation values of all the pixels cannot be overwritten at the same time, hence by performing sequential scanning, video signals are overwritten from the upper part to the lower part of the liquid crystal panel throughout the frame period when the image is input. In accordance with this sequential scanning, the light source performs scanning lighting to emit light by sequentially scanning from the upper part to the lower part of the liquid crystal panel.

However, in the case of the light source blinking once during one frame period, flicker is visually recognized. To reduce this flicker, the blinking control of the light source is performed by dividing one frame into a plurality of sub-frames.

Here the light emitted from the light source of the backlight diffuses in-plane, hence unintended leakage light (unintended brightness change) is generated, unless the emission of the light matches with the timing of the transmittance change of the liquid crystals (response speed). If this leakage light is most conspicuous, the leakage light is visually recognized as flicker.

Particularly in the case of performing the sub-frame light emission for a plurality of times to reduce flicker, the leakage light increases due to diffusion of light, which increases the frequency of generating flicker.

To solve this problem, a technique of detecting the change in the brightness of the images between frames, from a dark image to a light image, and delaying the timing to change the brightness of the backlight, was disclosed (Japanese Patent Application Publication No. 2015-049487).

SUMMARY OF THE INVENTION

However, in the case of the technique according to Japanese Patent Application Publication No. 2015-049487, the above-mentioned leakage light is not considered, therefore if the LD control or the GD control, which changes the brightness of the backlight in accordance with the video signal, is performed, leakage light is generated, and flicker is visually recognized.

The present invention in its first aspect provides a display apparatus comprising:

a light emission unit including a plurality of light sources that emit light;

a display unit configured to display an image by modulating the light on the basis of frames;

a determination unit configured to determine a luminescence intensity of each of the light sources for each sub-frame; and a control unit configured to control lighting of each of the light sources for each sub-frame at the luminescence intensity determined by the determination unit, wherein the determination unit is further configured to (1) determine a leakage light quantity, wherein the leakage light quantity is a transmission quantity of light from other light sources that is generated due to response delay in modulation by the display unit, for each region of the display unit corresponding to each of the light sources, and (2) determine the luminescence intensity in accordance with the difference of the leakage light quantity between the regions.

The present invention in its second aspect provides a control method of a display apparatus, wherein the display apparatus comprising (1) a light emission unit including a plurality of light sources that emit light, and (2) a display unit configured to display an image by modulating the light on the basis of frames, the control method comprising:

determining a luminescence intensity of each of the light sources for each sub-frame;

controlling lighting of each of the light sources for each sub-frame at the luminescence intensity;

determining a leakage light quantity, wherein the leakage light quantity is a transmission quantity of light from other light sources that is generated due to response delay in modulation by the display unit is determined for each region of the display unit corresponding to each of the light sources; and determining the luminescence intensity in accordance with the difference of the leakage light quantity between the regions.

The present invention in its third aspect provides a non-transitory computer readable medium that stores a program, wherein the program causes a computer to execute: a control method of a display apparatus, wherein the display apparatus comprising (1) a light emission unit including a plurality of light sources that emit light, and (2) a display unit configured to display an image by modulating the light on the basis of frames, the control method comprising:

determining a luminescence intensity of each of the light sources for each sub-frame;

controlling lighting of each of the light sources for each sub-frame at the luminescence intensity;

determining a leakage light quantity, wherein the leakage light quantity is a transmission quantity of light from other light sources that is generated due to response delay in modulation by the display unit is determined for each region of the display unit corresponding to each of the light sources; and determining the luminescence intensity in accordance with the difference of the leakage light quantity between the regions.

Further features of the present invention will become apparent from the following description of exemplary embodiments with reference to the attached drawings.

BRIEF DESCRIPTION OF THE DRAWINGS

FIG. 3 is a table indicating an example of light source lighting phase information TA according to the first embodiment;

FIG. 4 is a table indicating an example of responsiveness table data according to the first embodiment;

FIG. 14A and FIG. 14B are tables indicating examples of a control gain table data structure according to the second embodiment.

DESCRIPTION OF THE EMBODIMENTS

First Embodiment

A first embodiment of the present invention will be described.

<Overview>

An operation of a display apparatus according to the first embodiment, which controls the quantity of light emitted during a sub-frame period based on the brightness information of a light source and response information of a liquid crystal panel, will be described. The brightness information refers to information that indicates the brightness of a light emission unit, and is defined for each frame of the video signal. The response information of the liquid crystal panel refers to information that indicates the response speed of the liquid crystal panel, and is defined for each frame of the video signal. In the first embodiment, flicker is reduced by controlling the quantity of light in accordance with the response speed of the liquid crystal panel. The display apparatus according to the first embodiment will be described below in the sequence of: the general configuration, the processing content and the application examples.

<General Configuration>

Figure 1:
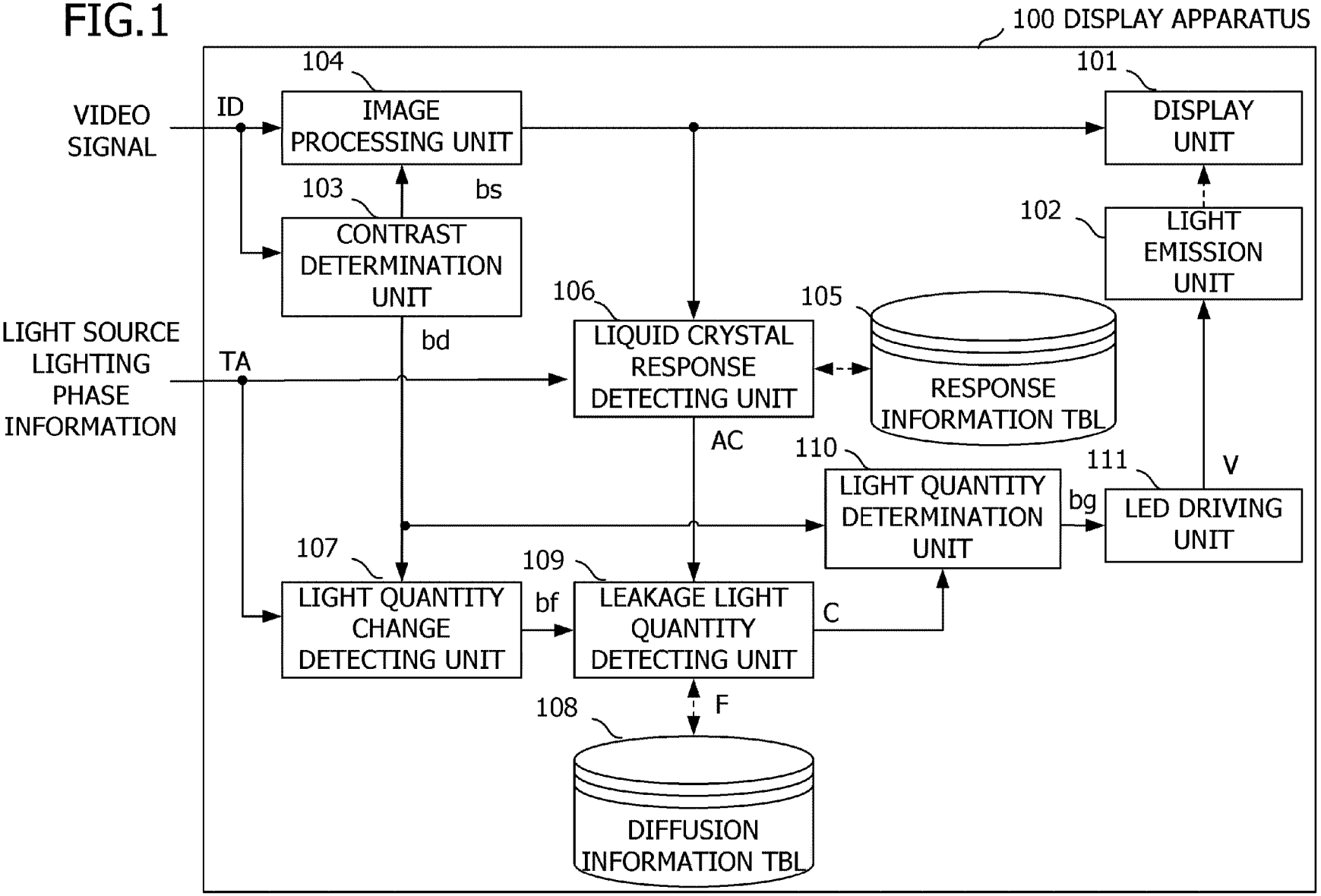
FIG. 1 is a functional block diagram depicting an example of a display apparatus according to a first embodiment.

FIG. 1 is a functional block diagram depicting an example of a display apparatus 100 according to the first embodiment. The display apparatus 100 is an information processing apparatus (computer) which includes: an arithmetic unit (processor), a memory, a storage device and an input/output device. By the display apparatus 100 executing programs stored in the storage device, the functions of a display unit 101, a light emission unit 102, a contrast determination unit 103, an image processing unit 104, a response information TBL 105, a liquid crystal response detecting unit 106 and the like of the display apparatus 100 are provided. Further, by the display of the display apparatus 100 executing the programs stored in the storage device, the functions of a light quantity change detecting unit 107, a diffusion information TBL 108, a leakage light quantity detecting unit 109, a light quantity determination unit 110, an LED driving unit 111 and the like of the display apparatus 100 are provided. A part or all of these functions may be implemented by dedicated logic circuits, such as ASIC and FPGA.

The display unit 101 is a functional unit that displays an image on the screen by transmitting light emitted from the light source. The display unit 101 includes a plurality of liquid crystal elements, and the transmittance of each liquid crystal element is controlled in accordance with the image data. The light emitted from the light source (light emission unit 102) is transmitted through the display unit 101 (each liquid crystal element) at the transmittance in accordance with input video signal, whereby an image is displayed on the screen. The image display apparatus according to the first embodiment may use display elements other than the liquid crystal display elements (e.g. MEMS shutters).

The light emission unit 102 is a member which irradiates light onto a back surface of the display unit 101. For example, the light emission unit 102 uses LEDs as the light source, and includes a plurality of control areas (width m×length n). The control area is driven in accordance with a lighting control signal V, which indicates a lighting control signal of the backlight output from the LED driving unit 111, and the light emission brightness of the LED of each control area can be independently (individually) controlled.

Figure 2:
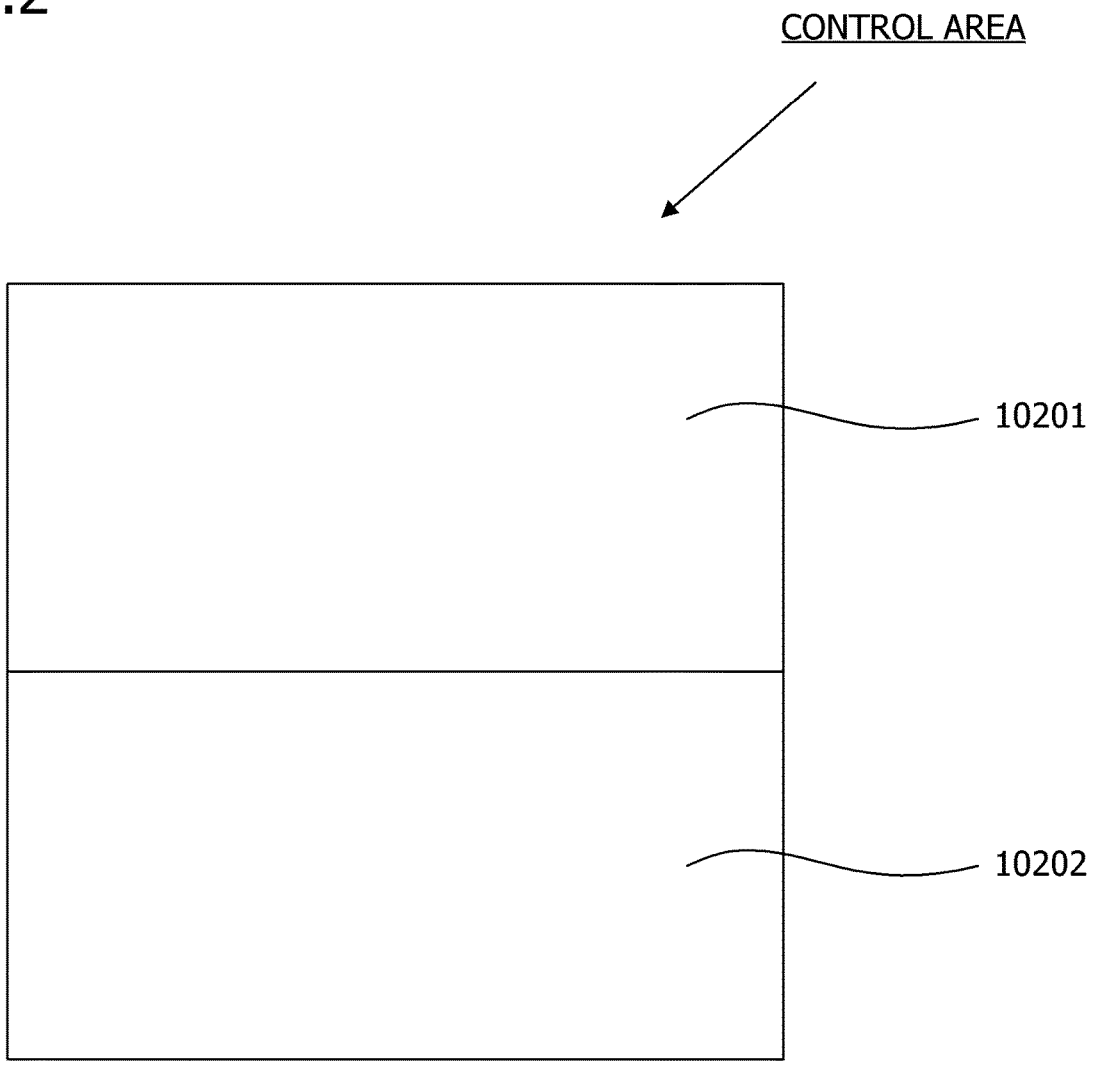
FIG. 2 is a diagram depicting an example of a control area according to the first embodiment.

FIG. 2 indicates an example of the divided control area of the light emission unit 102. In FIG. 2, only two control areas (control areas 10201 and 10202) are illustrated.

Light source lighting phase information TA is information indicating a timing to light each control area based on a vertical synchronizing signal of the video signal. The light source lighting phase information TA is lighting timing information when performing sub-frame light emission a plurality of times during one frame period.

FIG. 3 is an example of the light source lighting phase information TA. The column in FIG. 3 indicates the number of the control area, the row indicates a number of times of light emission in a sub-frame, and the lighting timing in each control area indicates normalized assuming the start of one frame period is 0 and the end thereof is 1. The light source lighting phase information TA in FIG. 3 is information when a number of control areas is 2, and a number of times of sub-frame emission is 2. The light source lighting phase information TA is expressed as $TA_{m,n}$, where m and n are the row number and column number of a position of the control area in which light is emitted. When the sub-frame number is SN, the light source lighting phase information of the sub-frame SN is expressed as $TA_{m,n}$ [SN]. For example, the light source lighting phase information $TA_{1,0}$ of the control area 10202 is 1.0 when sub-frame SN=1 ($TA_{1,0}$ [1]), and is 1.5 when sub-frame SN=2 ($TA_{1,0}$ [2]) according to FIG. 3. The reason why the value, when the sub-frame SN is 1, is 1.0, is because the response of the liquid crystals takes 0.5 frame, to which about a 0.5 frame delay in the sequential scanning from the top to the bottom of the liquid crystals, is added.

The contrast determination unit 103 is a functional unit which determines signal gain information bs of the display unit 101 and the light source brightness information bd of each control area of the light emission unit 102, in accordance with the input video signal. The signal gain information bs is information on a coefficient by which the input video signal is multiplied. The light source brightness information bd is information on brightness corresponding to each control area of the light emission unit 102. The contrast determination unit 103 determines the brightness of each control area based on the signal value of the input image. The determined light source brightness information bd of each control area is output to the light quantity change detecting unit 107, and the determined signal gain information bs of each control area is output to the image processing unit 104. The processing by the contrast determination unit 103 will be described in detail later.

The image processing unit 104 is a functional unit which generates a video signal by multiplying an input video signal by the signal gain information bs, which is output from the contrast determination unit 103. The image processing unit 104 outputs the generated video signal to the display unit 101 and the liquid crystal response detecting unit 106.

The response information TBL 105 is table data which stores the responsiveness (response delay amount; response delay time), which indicates the required time until completion of a change of transmittance in the display unit 101 in accordance with the change of the video signal. FIG. 4 is an example of the responsiveness table data structure. The column in FIG. 4 indicates the signal gradation of the current frame (target frame), and the row indicates the signal gradation of the previous frame. The responsiveness table data in FIG. 4 stores the normalized values of the time required until the signal is switched, and the transmittance is changed, assuming one frame period, based on the relationship between the signal gradation in the current frame and the signal gradation in the previous frame.

The liquid crystal response detecting unit 106 is a functional unit which detects a transmittance change amount AC, which is a ratio of the quantity of light, diffused from other light sources, transmitting through a target control area of the display unit 101 with respect to all the light transmitting through the target control area during the response delay time. The liquid crystal response detecting unit 106 detects the transmittance change amount AC based on the video signal output from the image processing unit 104 and the responsiveness table data from the response information TBL 105. The liquid crystal response detecting unit 106 detects the transmittance change amount AC for each control area and in each frame period, and outputs the result to the leakage light quantity detecting unit 109. The processing by the liquid crystal response detecting unit 106 will be described in detail later. The transmittance change amount AC may be detected considering the light source lighting phase information TA, which indicates the lighting timing of each control area.

The light quantity change detecting unit 107 is a functional unit which detects light source change information bf, that is, the change amount of luminescence intensity in each sub-frame period, based on the light source brightness information bd output from the contrast determination unit 103 and the light source lighting phase information TA. Then the light quantity change detecting unit 107 outputs the light source change information bf to the leakage light quantity detecting unit 109. The processing by the light quantity change detecting unit 107 will be described in detail later.

The diffusion information TBL 108 is diffusion information table data F which stores a quantity of diffused light when each control area of the light emission unit 102 is individually lit. This diffusion information table data F has values indicating the luminescence intensity of the diffused light in the entire light emission unit 102 when the target control area emits light, and these values are measured and digitized in advance for each control area. The diffusion information table data F is output to the leakage light quantity detecting unit 109. The diffusion information table data F has a four-dimensional matrix, in which m and n are a row number and a column number, to indicate the control area where light is emitted, and m' and n' are a row number and a column number of the diffusion destination area. The diffusion information table data F is provided for each control area where light is emitted, and the value increases as the luminescence intensity increases.

Figure 5A:
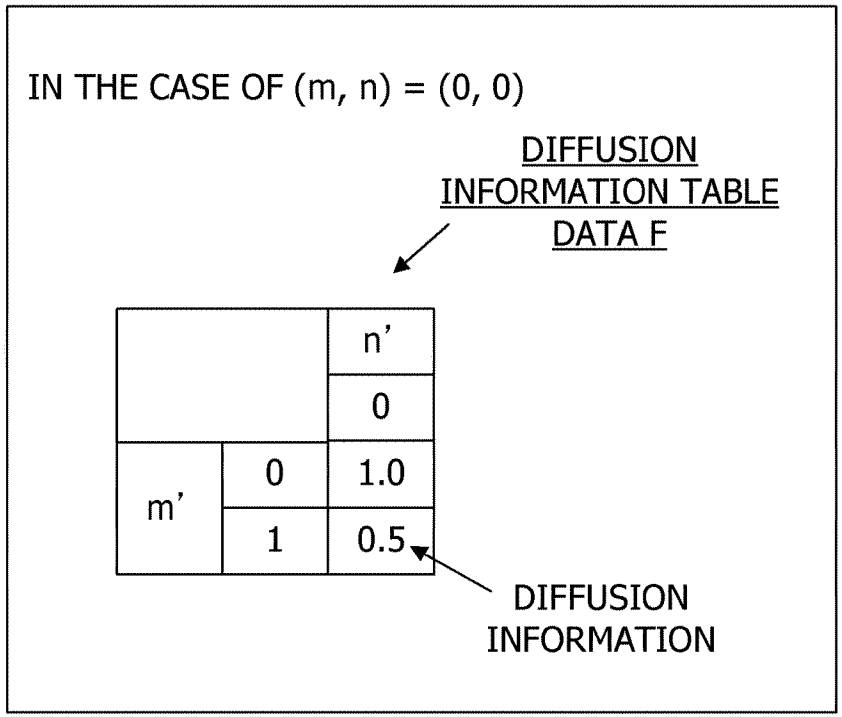
FIG. 5A and FIG. 5B are tables indicating examples of diffusion information table data according to the first embodiment.
Figure 5B:
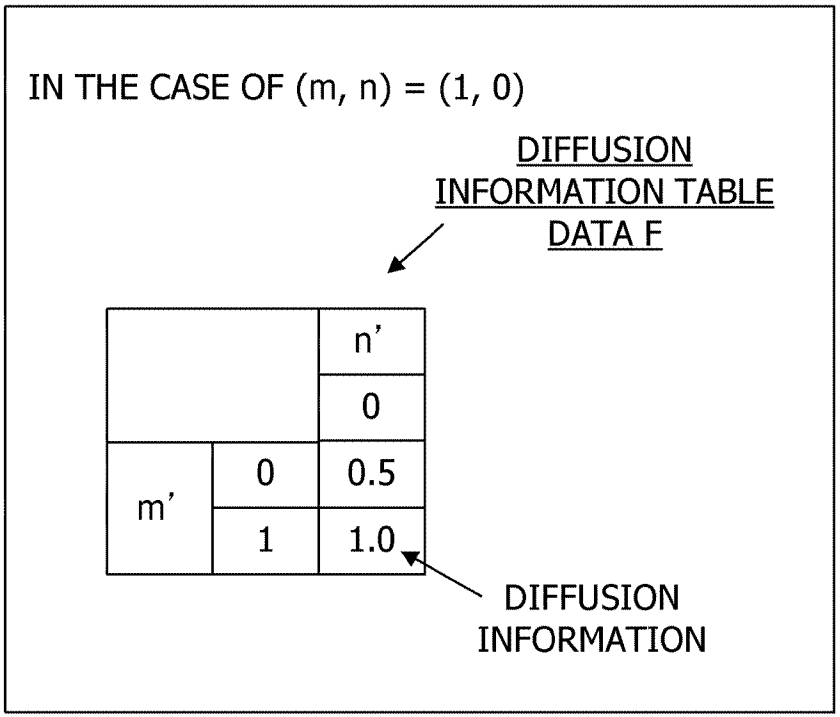

FIG. 5A and FIG. 5B are schematic diagrams depicting the data structure of the diffusion information tables. FIG. 5A indicates a diffusion information table when the control area at the 0th row and 0th column emits light, and FIG. 5B indicates a diffusion information table when the control area at the first row and 0th column emit light. In FIG. 5A, the value at the 0th row and the 0th column at which the control area emits light is the largest, and the value at the first row and the 0th column is smaller since the diffused light weakens as it becomes distant from the control area.

The leakage light quantity detecting unit 109 is a functional unit which detects the leakage light quantity C, which is an error from the value of the ideal light quantity determined in each frame period. In concrete terms, the leakage light quantity detecting unit 109 detects the leakage light quantity C by multiplying the diffused light quantity FY, which is a quantity of light diffused from other light sources to the target control area, by the transmittance change amount AC. The diffused light quantity FY is determined based on the light source change amount bf and the diffusion information table data F. The leakage light quantity C indicates a transmission amount (light quantity) of the light from other light sources, which is generated by the response delay of the display unit 101 when the light emission unit 102 is lit based on the light source brightness information bd. The leakage light quantity detecting unit 109 outputs the detected leakage light quantity C to the light quantity determination unit 110. The processing by the leakage light quantity detecting unit 109 will be described in detail later.

The light quantity determination unit 110 is a functional unit which determines light source control information bg in a sub-frame period, so as to reduce the leakage light quantity, based on the leakage light quantity C output from the leakage light quantity detecting unit 109 and the light source brightness information bd output from the contrast determination unit 103. The light quantity determination unit 110 outputs the determined light source control information bg to the LED driving unit 111. The processing by the light quantity determination unit 110 will be described in detail later.

The LED driving unit 111 is a functional unit which outputs a lighting control signal V to the light emission unit 102 in each sub-frame period, based on the light source control information bg from the light quantity determination unit 110 and the synchronizing signal of the input video signal.

<Processing Content>

Details of the processing by the contrast determination unit 103, the liquid crystal response detecting unit 106, the light quantity change detecting unit 107, the leakage light quantity detecting unit 109 and the light quantity determination unit 110 will now be described.

<<Contrast Determination Unit 103: Light Source Brightness Information Bd and Signal Gain Information Bs Determining Processing>>

A method of the contrast determination unit 103 calculating the light source brightness information bd and the signal gain information bs for each control area of the light emission unit 102 will be described. The calculation procedure will be described below.

(Step S101)

In step S101, the contrast determination unit 103 converts each pixel data of the input video signal into a brightness value. For example, if RGB signals are input as the video signals, the contrast determination unit 103 converts the RGB signals into a brightness value Y using the following Expression (1).

$$\gamma=\alpha\times R+\beta\times G+\gamma\times B \tag{1}$$

Here α, β and γ are brightness conversion coefficients when each signal value of R, G and B is converted into a brightness value.

(Step S102)

Then the contrast determination unit 103 determines the brightness of the backlight in each control area. The contrast determination unit 103 calculates an average value Ya of the brightness value Y, calculated in step S101, for each pixel included in the control area. Here the brightness of the backlight of a lighting control area at the mth row and the nth column is assumed to be $Ya_{m,n}$.

(Step S103)

In step S103, for each control area, the contrast determination unit 103 determines the brightness of the backlight as the light source brightness information. If the brightness in each area calculated in step S101 and step S102 is $Ya_{m,n}$, and the maximum brightness value is $Y_{max}$, then the light source brightness information bd is determined by the following Expression (2).

$$bd_{m,n} = \frac{Ya_{m,n}}{Y_{max}} \tag{2}$$

Here the light source brightness information $bd_{m,n}$ is a normalized average brightness value of an area m, n, which is determined based on the input image signal. The brightness of the LED in each area is controlled based on this light source brightness information $bd_{m,n}$. It is assumed that $bd_{m,n}$ is a matrix having a size of m rows×n columns. In the first embodiment, the light source brightness information $bd_{m,n}$ is indicated by an 8-bit value (an integer in a 0 to 255 range), and as this value is greater, the control area emits light more brightly. In the first embodiment, the contrast determination unit 103 determines the light source brightness information bd based on the brightness in each control area, but may determine the light source brightness information bd based on the general brightness of the video signal.

(Step S104)

In step S104, the contrast determination unit 103 determines the signal gain bs for each control area. The signal gain bs for each control area is a correction gain information by which the video signal for each control area is multiplied, and indicates the light source brightness information $bs_{m,n}$ in the control area on the mth row and the nth column when the light emission unit 102 is divided into m vertically and n horizontally as the brightness control areas. In other words, $bs_{m,n}$ is a matrix having a size of m rows×n columns. Based on the light source brightness information bd for each control area determined in step S103, the contrast determination unit 103 calculates the signal gain bs using the following Expression (3).

$$bs_{m,n} = \left(\frac{bd_{max}}{bd_{m,n}}\right)^{\frac{1}{pgam}} \tag{3}$$

Here $bd_{max}$ is a maximum value of the light source brightness information bd, and pgam is a gamma value of the display unit 101. For example, when the gamma value of a liquid crystal panel is 2.2, pgam is 2.2. In other words, using Expression (3), the contrast determination unit 103 calculates an amount of multiplication, so that the dropped amount of light quantity of the light source is compensated for in the signal processing.

<<Liquid Crystal Response Detecting Unit 106: Transmittance Change Amount AC Detecting Processing>>

A method of the liquid crystal response detecting unit 106 calculating the transmittance change amount AC (ratio of the quantity of light diffused from other light sources transmitting through the target control area of the display unit 101 during response delay time), based on the image output from the image processing unit 104 and the responsiveness table data, will be described. The calculation procedure will be described below.

(Step S201)

In step S201, the liquid crystal response detecting unit 106 determines the liquid crystal response value A based on the pixel value of the input video signal. The liquid crystal response value A is the time required until the target pixel has a desired transmittance. For example, if RGB signals are input as the video signals, the liquid crystal response value A is determined using the following Expression (4).

$$A = \frac{\{\text{table_rsp}(R_{new}, R_{old}) + \text{table_rsp}(G_{new}, G_{old}) + \text{table_rsp}(B_{new}, B_{old})\}}{3} \tag{4}$$

Here table_rsp is the responsiveness table data of the response information TBL 105. $R_{old}$, $G_{old}$ and $B_{old}$ are the RGB data (pixel values) of the video signal in the previous frame respectively. $R_{new}$, $G_{new}$ and $B_{new}$ are RGB data of the video signal of the current frame respectively. table_rsp ($R_{new}$, $R_{old}$) indicates a response delay amount when the $R_{old}$ gradation of the responsiveness table data changed to the $R_{new}$ gradation. In other words, in Expression (4), the response delay amount in each pixel is calculated from the change of each RGB signal.

(Step S202)

Then the liquid crystal response detecting unit 106 determines the average liquid crystal response value $A_{avg}$ for each control area. The liquid crystal response detecting unit 106 determines an average liquid crystal response value $A_{avg}$ for each control area, which is an average value of the liquid crystal response value A of each pixel included in the control area calculated in step S201. Here the average liquid crystal response value of a lighting control area at the mth row and the nth column is assumed to be $A_{avg_m,n}$. This average liquid crystal response value $A_{avg}$ is an average time that is required until the pixels included in each control area become a desired transmittance.

(Step S203)

In step S203, the liquid crystal response detecting unit 106 determines the transmittance change amount AC for each control area. The transmittance change amount AC is determined by dividing the average liquid crystal response value $A_{avg}$ for each control area determined in step S202 by a coefficient Ka. Here the liquid crystal response detecting unit 106 determines the transmittance change amount AC for each control area based on the input light source lighting phase information TA and elapsed time TB in one frame period (time when one frame of a video signal starts is 0, and time when this frame ends is 1). In concrete terms, if any one of the control areas has $TA_{m,n}$ [SN]−TC (response time of liquid crystal panel) which becomes the same value as TB ($TA_{m,n}$ [SN]−TC=TB), the transmittance change amount AC in this control area is detected using the following Expression (5).

$$AC_{m,n} = \begin{cases} \dfrac{A_{avg_m,n}[N]}{Ka} & (A_{avg_m,n}[N] > TB) \\ 0 & (A_{avg_m,n}[N] \leq TB) \end{cases} \tag{5}$$

If $TA_{m,n}$ [SN]−TC of a control area is greater than TB ($TA_{m,n}$ [SN]−TC>TB), then the transmittance change amount AC in this control area is detected using the following Expression (6).

$$AC_{m,n} = \begin{cases} \dfrac{A_{avg_m,n}[N-1]}{Ka} & (A_{avg_m,n}[N-1] > TB + TC) \\ 0 & (A_{avg_m,n}[N-1] \leq TB + TC) \end{cases} \tag{6}$$

Here the coefficient Ka indicates a value which changes in accordance with the response characteristic of the liquid crystal panel, and $A_{avg}$ [N] indicates the average liquid crystal response value in the Nth frame. Normally the response of liquid crystals has such a response characteristic as a LOG function. In other words, the coefficient Ka is a division coefficient to simply calculate AC, which is a ratio of the quantity of light diffused from other light sources, transmitting through the target control area of the display unit 101 during the response delay time. In the first embodiment, the coefficient Ka is 2 to make the effect clearly recognizable, but the value of the coefficient Ka is not especially limited. In order to decrease error in calculating the change of transmittance, Ka matching with the actual transmittance with the liquid crystals may be provided for each gradation change in small time units, similarly to the responsiveness table data.

<<Light Quantity Change Detecting Unit 107: Light Source Change Information Bf Detecting Processing>>

Then the light quantity change detecting unit 107 determines the light source change information bf based on the difference calculation of the light source brightness information bf, which changes in each frame period of the video signal, and the light source lighting phase information TA, and outputs the determined light source change information bf to the leakage light quantity detecting unit 109. The calculation procedure will be described below.

(Step S301)

In step S301, the light quantity change detecting unit 107 calculates the difference of the light source brightness information bd input from the contrast determination unit 103 (Expression 7).

$$be_{m,n}[N]=bd_{m,n}[N-1]-bd_{m,n}[N] \tag{7}$$

Here $bd_{m,n}$ [N] is the light source brightness information at the mth row and the nth column in the Nth frame. $be_{m,n}$ [N] is a difference information of the lighting control area at on the mth row and the nth column in the Nth frame.

(Step S302)

Then in order to make the light source change information bf a value considering the sub-frame, the light quantity change detecting unit 107 calculates the light source change information bf matching with the phase when the light source actually turns ON for each control area, based on the light source lighting phase information TA. The light quantity change detecting unit 107 detects the light source change information bf for each control area based on the elapsed time TB in one frame (time when one frame of the input video signal starts is 0, and time when the signal ends is 1). Here if any one of the sub-frames of $TA_{m,n}$ [SN] becomes the same value as TB ($TA_{m,n}$ [SN]=TB), the light source change information bf in the control area is detected using the following Expression (8).

$$bf_{m,n}[\mathrm{SN}]=be_{m,n}[N] \tag{8}$$

If $TA_{m,n}$ [SN] is greater than TB ($TA_{m,n}$ [SN]>TB), the light source change information bf in the control area is detected using the following Expression (9).

$$bf_{m,n}[\mathrm{SN}]=be_{m,n}[N-1] \tag{9}$$

Normally backlight is sequentially lit from the upper part to the lower part of the screen. In other words, the brightness in each sub-frame period of the sequentially lighting backlight is detected using Expression (8) and Expression (9). As a consequence, the brightness information at the lighting timing in each control area can be accurately detected, whereby the state of the light source instantaneously emitting light can be estimated.

<<Leaked Light Quantity Detecting Unit 109: Leakage Light Quantity C Detecting Processing>>

A method of the leakage light quantity detecting unit 109 detecting, in each frame period, the leakage light quantity C, which is an error from the value of the ideal light quantity determined in each frame period, when the light emitted from the light emission unit 102 is transmitted through the display unit 101, will be described. The leakage light quantity detecting unit 109 detects the leakage light quantity C based on the light source change information bf output from the light quantity change detecting unit 107, the diffusion information table data F of the diffusion information TBL 108, and the transmittance change amount AC detected by the liquid crystal response detecting unit 106. The calculation procedure will be described below.

(Step S401)

In step S401, the leakage light quantity detecting unit 109 calculates the diffused light quantity FY for each control area by multiplying the light source change information bf output from the light quantity change detecting unit 107 by the diffusion information table data F of the diffusion information TBL 108 (Expression 10).

$$FY_{m,n} = \sum_{m',n'} (F_{m',n',m,n} \times bf_{m',n'}) \tag{10}$$

(Step S402)

Then in step S402, the leakage light quantity detecting unit 109 calculates the leakage light quantity $C_{m,n}$ for each control area, based on the diffused light quantity FY and the transmittance change amount AC from the liquid crystal response detecting unit 106. In the first embodiment, the leakage light quantity $C_{m,n}$ is calculated by multiplying the diffused light quantity FY by the transmittance change amount AC from the liquid crystal response detecting unit 106 ($C_{m,n}=FY_{m,n}\times AC_{m,n}$).

<<Light Quantity Determination Unit 110: Light Source Control Information Bg Determining Processing>>

A method of the light quantity determination unit 110 calculating the light source control information bg in the sub-frame period, so as to decrease the leakage light quantity C output from the leakage light quantity detecting unit 109, will be described. The calculation procedure will be described below.

(Step S501)

In step S501, the light quantity determination unit 110 calculates a total leakage light quantity CD for one frame in each control area (Expression 11).

$$CD_{m,n}[N] = \sum_{SN} C_{m,n}[SN] \tag{11}$$

(Step S502)

Then in step S502, the light quantity determination unit 110 detects the difference CE, which is the difference value between the maximum value and the minimum value of the total leakage light quantity CD between control areas (between regions) (Expression 12).

$$CE = \max_{m,n}(CD_{m,n}[N]) - \min_{m,n}(CD_{m,n}[N]) \tag{12}$$

(Step S503)

Then in step S503, the light quantity determination unit 110 determines whether the difference CE is greater than a threshold Th (at least the threshold or less than the threshold), and determines the light source control information bg. The threshold Th is a ratio of light quantity that may be changed in one frame period, and is set to a value with which flicker is not visually recognized very much, even if there is a leakage light quantity difference among control areas. If the difference CE is the threshold Th or less, or if the sub-frame is the final sub-frame, the light quantity determination unit 110 determines the light source control information bg using the following Expression (13).

$$\begin{aligned} bg_{m,n}[SN] &= \{bd_{m,n}[N] - bd_{m,n}[N-1]\} + bd_{m,n}[N-1] \\ &= bd_{m,n}[N] \end{aligned} \tag{13}$$

Otherwise, the light quantity determination unit 110 determines the light source control information bg using the following Expression (14).

$$bg_{m,n}[SN] = \{bd_{m,n}[N] - bd_{m,n}[N-1]\} \times \frac{U}{100} + bg_{m,n}[SN-1] \tag{14}$$

Here it is assumed that $bg_{m,n}[SN-1]=bd_{m,n}[N-1]$ if the sub-frame SN=1. U ($0 \le U \le 100$) is a degree of suppressing the brightness of the light source in the sub-frame. As the value U is smaller, the change amount between sub-frames decreases, hence the brightness of the light source changes gradually.

The threshold Th is a value determined in accordance with the characteristics of the display unit 101 and the light emission unit 102, and can be determined in advances by measuring with an instrument or by visual inspection. U and the threshold Th may be a same value or different values from each other.

By performing the above processing, the leakage light quantity C is calculated for each control area based on the sub-frame light emission (FY) of the light source, and the response delay (AC) of the liquid crystals. Then the sub-frame brightness (bg) of the light source can be controlled such that the leakage light quantity is not visually recognized. In other words, flicker can be suppressed.

Application Example 1

A concrete application example of performing the flicker suppression control will be described with reference to FIG. 6 to FIG. 10. First an input video signal will be described.

Figure 6:
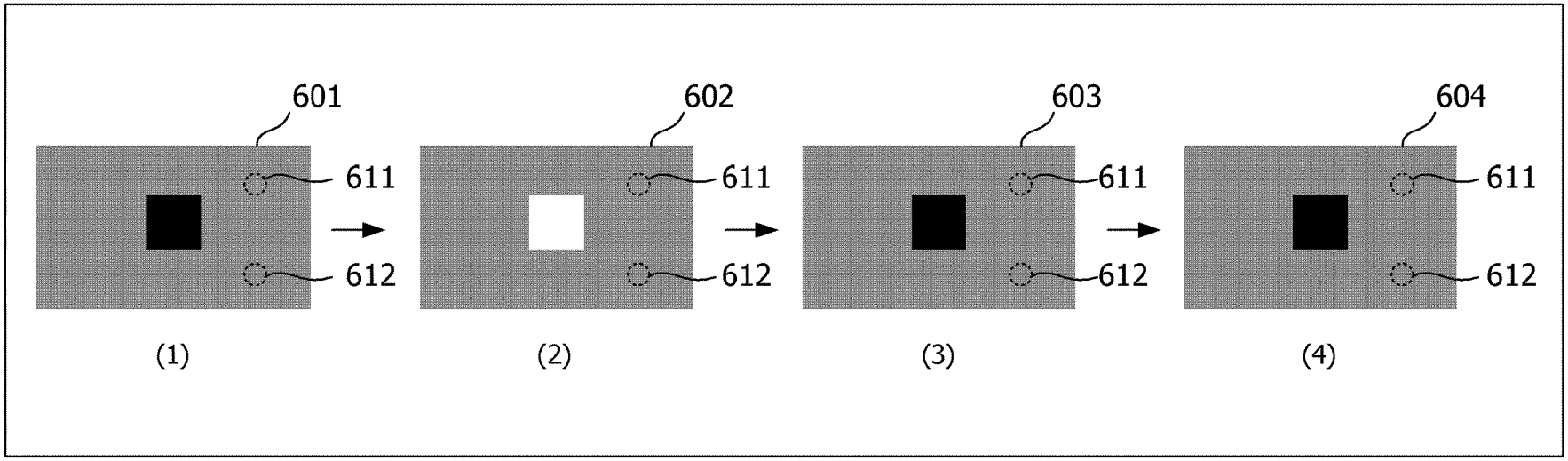
FIG. 6 is a diagram depicting an example of temporal change images of video signals according to the first embodiment.

FIG. 6 is a diagram depicting an example of the temporal time change images of video signals. In a video signal 601, a small area image of which gradation value is 0 is displayed at the center of the screen, against a gray background of which gradation value is 128. In a video signal 602, a small area image of which gradation value is 255 is displayed at the center of the screen, against a gray background of which gradation value is 128. The video signals 603 and 604 are the same video signals as the video signal 601.

The light emission unit 102, which displays the video signals in FIG. 6, is divided into two regions, top and bottom, on the screen, similarly to the schematic diagram described in FIG. 2. In these control regions 10201 and 10202, the regions of the video signal corresponding to the gray background are assumed to be the regions 611 and 612 respectively.

<<Conventional Method>>

Changes of the transmittance of the liquid crystals, which the contrast determination unit 103 determined in accordance with the input video signal, and the light source control values, according to a conventional control, will be described next.

Figure 7:
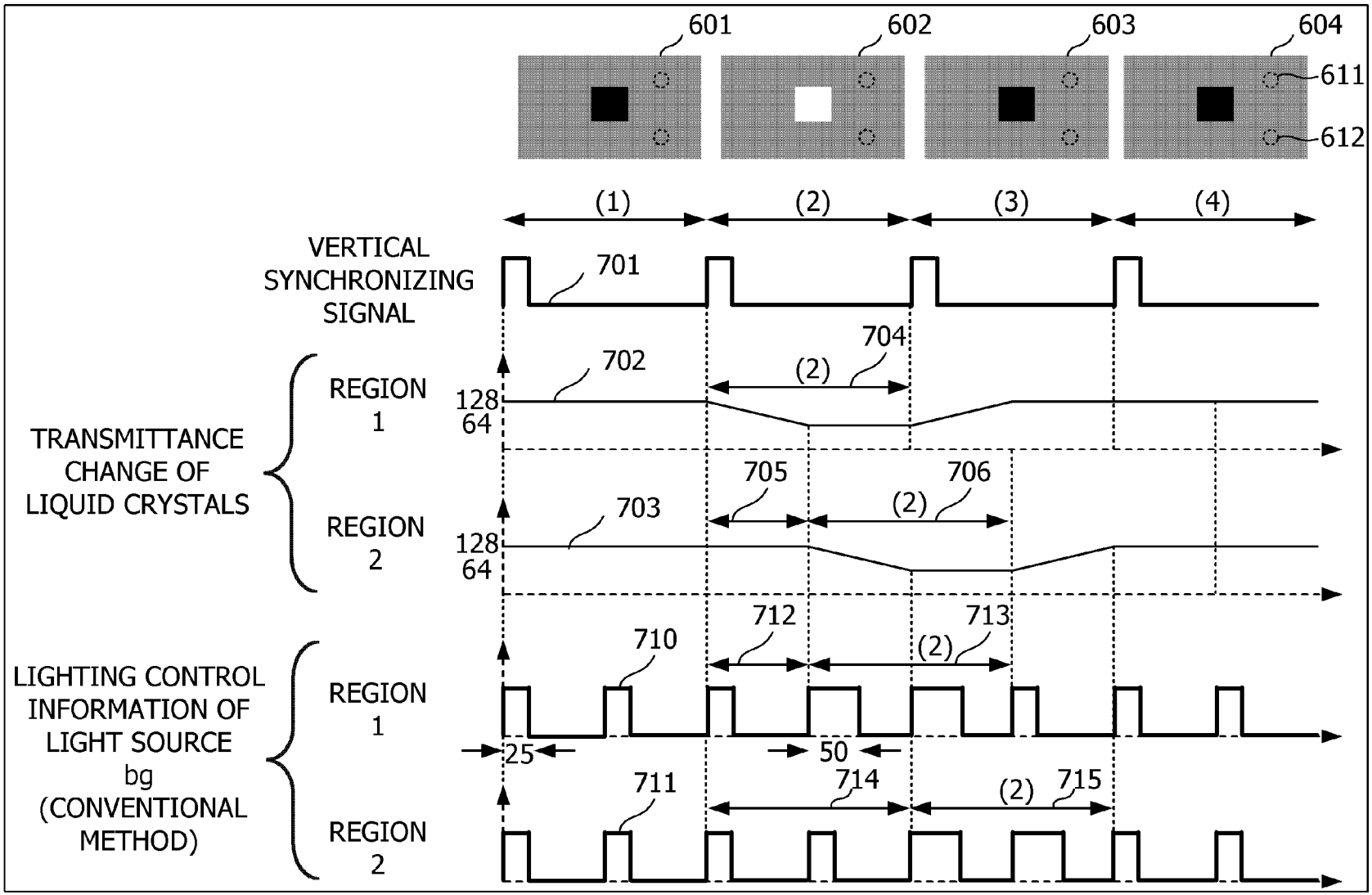
FIG. 7 is a diagram depicting an example of a transmittance change and a lighting control of the light source according to a conventional method.

FIG. 7 is a diagram depicting an example of a transmittance change and a lighting control of the light source in accordance with the change of video signals according to a conventional method. In FIG. 7, an example, when the contrast determination unit 103 controls the transmittance of the liquid crystals to half and the brightness of the light source to double for the input video signals 601 to 604, will be described. To simplify calculation, the gamma value (pgam) of the liquid crystal panel is assumed to be 1.0.

A synchronizing signal 701 in FIG. 7 is a vertical synchronizing signal of the input video signal. 702 is a transmittance signal that indicates the transmittance change of the liquid crystals in the region 611. 703 is a transmittance signal that indicates the transmittance change of the liquid crystals in the region 612. 704 is a frame period in which the video signal 602 is displayed on a crystal portion corresponding to the region 611. 705 is a wait time until the video signal 602 is displayed on the liquid crystal portion corresponding to the region 612. 706 is a frame period in which the video signal 602 is displayed on a crystal portion corresponding to the region 612. In both the regions 611 and 612, the gradation value is decreased from 128 to 64 (half) when the video signal 601 changes to the video signal 602.

In this diagram, it is assumed that the response of the liquid crystals changes linearly to simplify description.

710 is a brightness control signal that indicates the brightness change of the light source in the region 611. 711 is a brightness control signal that indicates the brightness change of the light source in the region 612. 712 is a time to delay the brightness control of the light source in the region 611 by a 0.5 frame period, so as to stabilize the response change of the liquid crystals, in accordance with the light source lighting phase information TA. 713 is a frame period in which the lighting control of the light source, corresponding to the video signal 602, is performed in the region 611. 714 is a time to delay the brightness control of the light source in the region 612 by a 1.0 frame period, so as to stabilize the response change of the liquid crystals, in accordance with the light source lighting phase information TA. 715 is a frame period in which the lighting control of the light source, corresponding to the video signal 602, is performed in the region 612. In both regions 611 and 612, the brightness control amount of the light source increased from 25 to 50 (double) when the video signal 601 changes to the video signal 602, so that the display brightness does not change.

Figure 8:
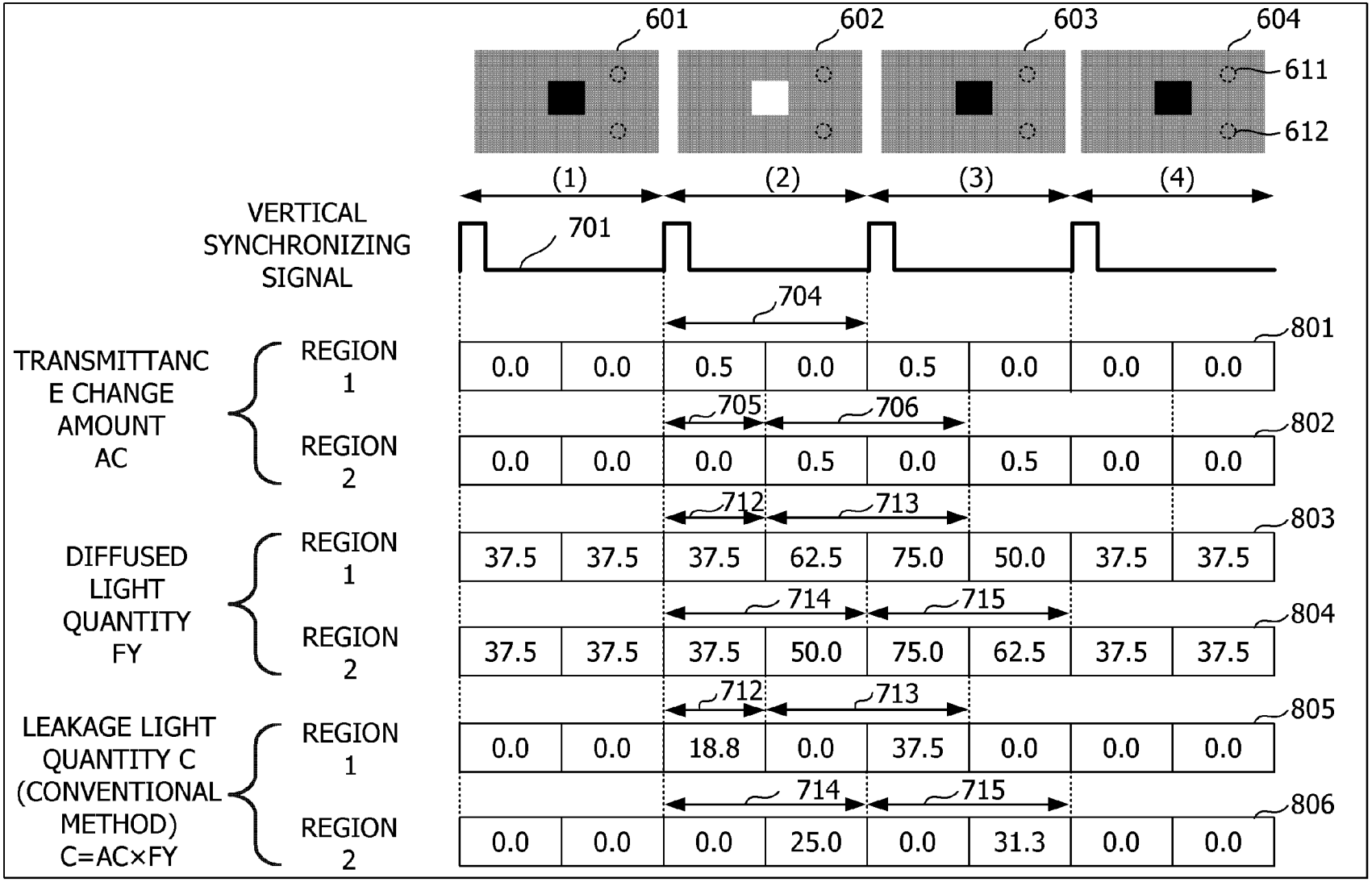
FIG. 8 is a diagram depicting an example of the result of a leakage light quantity according to a conventional method.

FIG. 8 is a diagram depicting an example of the result of a leakage light quantity C according to a conventional method, when the transmittance control and the light source control in FIG. 7 are performed. The target frame is assumed to be the frame to which the image 602 is input.

The calculation results 801 and 802 are the results of calculating the transmittance change amount AC in the regions 611 and 612 respectively. The transmittance change amount AC is calculated using the responsiveness table data in FIG. 4. In both the regions 611 and 612, the period in which the transmittance does not change is 0.0, and the period, in which the gradation value changes from 128 to 64 or 64 to 128, is 0.5. In the frame periods 704 and 706, in which the video signal 604 is displayed, the gradation value is 0.5 in a period in which the transmittance of the liquid crystals changes, and is 0.0 in a subsequent period in which the transmittance change is stabilized.

The calculation results 803 and 804 are the results of calculating the diffused light quantity FY of the light sources in the regions 611 and 612 respectively based on the conventional method. The diffused light quantity FY is calculated using the diffusion table data in FIG. 5A and FIG. 5B. In the region 611, the light quantity from the region 612 is added, and in the region 612, the light quantity from the region 611 is added. In the frame period 713 in which the video signal 602 is displayed, the diffused light quantity FY is 62.5 in a period in which the transmittance change of the liquid crystals is stable, and is 75.0 in a subsequent period in which the transmittance changes. In the frame period 715, the diffused light quantity FY is 75.0 in a period in which the transmittance change of the liquid crystals is stable, and is 62.5 in a subsequent period in which the transmittance changes.

The calculation results 805 and 806 are the results of calculating the leakage light quantity C in the regions 611 and 612 respectively based on the conventional method. The leakage light quantity C is calculated using the transmittance change amount AC and the diffused light quantity FY. In both the regions 611 and 612, the diffused light quantity FY is visually recognized as the leakage light quantity C in a period in which the transmittance of the liquid crystals changes.

In the frame period 713 in which the video signal 602 is displayed, the total leakage light quantity is 37.5. In the frame period 715, the total leakage light quantity is 31.3. Since the leakage light quantity is different between the region 611 and the region 612 like this, this light quantity difference is visually recognized as flicker.

In other words, flicker is visually recognized in the conventional method which shifts the phase in which brightness of the light source is changed in accordance with the response of the liquid crystal panel.

<<Present Method>>

The generation of the leakage light quantity C, in the case of the control according to the first embodiment, will be described next.

Figure 9:
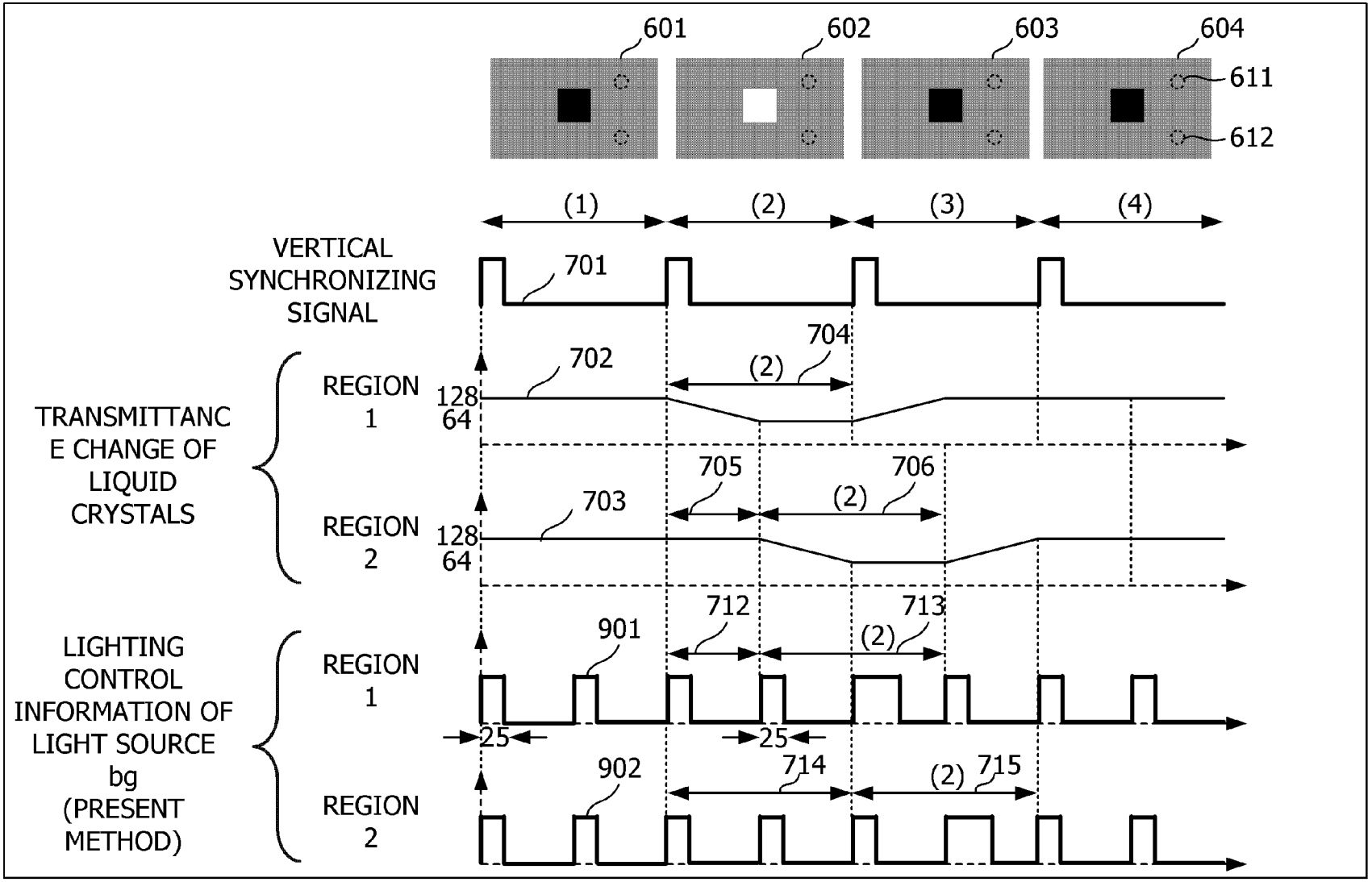
FIG. 9 is a diagram depicting an example of a transmittance change and a lighting control of a light source according to the first embodiment.

FIG. 9 is a diagram depicting an example of the transmittance change of the liquid crystals in FIG. 7, and the lighting control of the light source. FIG. 9 is a result of calculating based on the assumption that the threshold Th of the light quantity determination unit is 0.

A signal 901 is a brightness control signal that indicates the brightness change of the light source in the region 611. A signal 902 is a brightness control signal that indicates the brightness change of the light source in the region 612. In the first embodiment, the brightness is controlled such that the light source control value in the first sub-frame period of the period 713 in FIG. 9 does not change. In the same manner, the brightness is changed such that the light source control value in the first sub-frame period of the period 715 does not change. This is because the leakage light quantity detecting unit 109 determines that the leakage light quantity difference is generated between the region 611 and the region 612, as indicated in FIG. 8.

Figure 10:
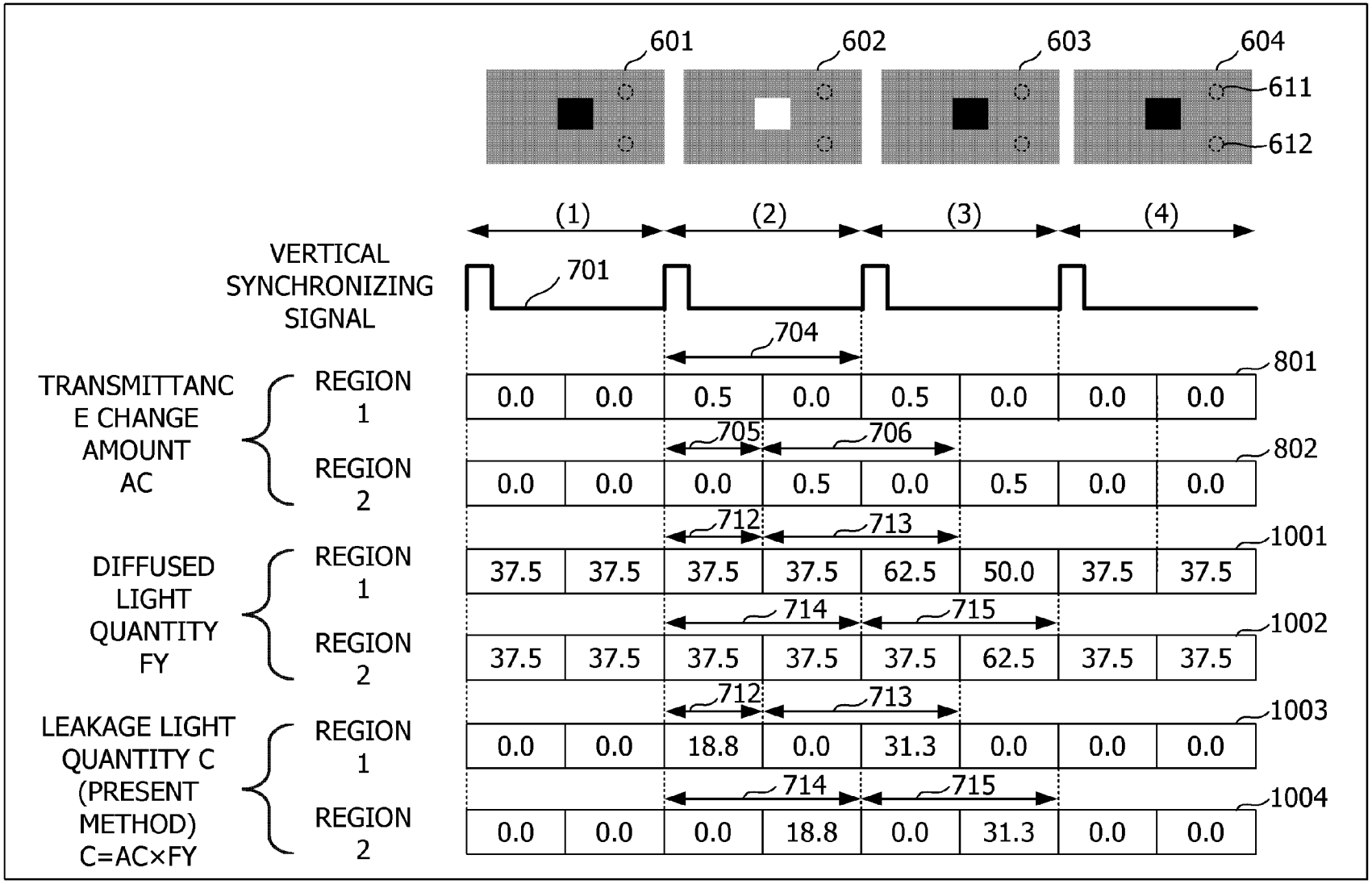
FIG. 10 is a diagram depicting a result of a leakage light quantity according to the first embodiment.

FIG. 10 is a diagram depicting the leakage light quantity C according to the first embodiment in the case when the light source control in FIG. 9 is performed. As in FIG. 8, the target frame is assumed to be the frame to which the image 602 is input.

The calculation results 1001 and 1002 are the results of calculating the diffused light quantity FY of the light sources in the regions 611 and 612 respectively based on the first embodiment. In the frame period 713 in which the video signal 602 is displayed, the diffused light quantity FY is 37.5 in a period in which the transmittance change of the liquid crystals is stable, and is 62.5 in a subsequent period in which the transmittance changes. In the frame period 715, the diffused light quantity FY is 37.5 in a period in which the transmittance change of the liquid crystals is stable, and is 62.5 in a subsequent period in which the transmittance changes. In this way, the diffused light quantity FY is the same in both the regions 611 and 612.

The calculation results 1003 and 1004 are the results of calculating the leakage light quantity C in the regions 611 and 612 respectively. In the frame period 713 in which the video signal 602 is displayed, the total of the leakage light quantity is 31.3. In the frame period 715, the total of the leakage light quantity is 31.3. In this way, the leakage light quantity is the same in both the regions 611 and 612, hence flicker is reduced. In other words, flicker can be suppressed by controlling the light quantity in the sub-frame period, and controlling such that the leakage light quantity difference is not generated.

By performing the above processing, the leakage light quantity can be calculated based on the sub-frame light emission of the light source and response delay of the liquid crystals for each control area. Then the leakage light quantity is reduced by controlling the sub-frame brightness of the light source such that the leakage light quantity is not visually recognized, thereby flicker can be suppressed.

Further, the response speed of liquid crystals is normally slow, which is about 8 ms (about half of one frame period), hence in the case of performing the sub-frame light emission of the light source, the leakage light is reduced by gradually changing the light quantity of the light source. For example, in the case where the light quantity of the light source changes and becomes brighter, the brightness in the sub-frame light emission of the light source is controlled to have a brightness change curve that is downwardly convex with respect to the linear brightness change. In the case where the light quantity of the light source changes and becomes darker, the brightness in the sub-frame light emission of the light source is controlled to have a brightness change curve that is upwardly convex with respect to the linear brightness change.

Application Example 2

An application example of performing the lighting control of the light source (reducing brightness), when a number of sub-frames is five, will be described with reference to FIG. 11.

Figure 11:
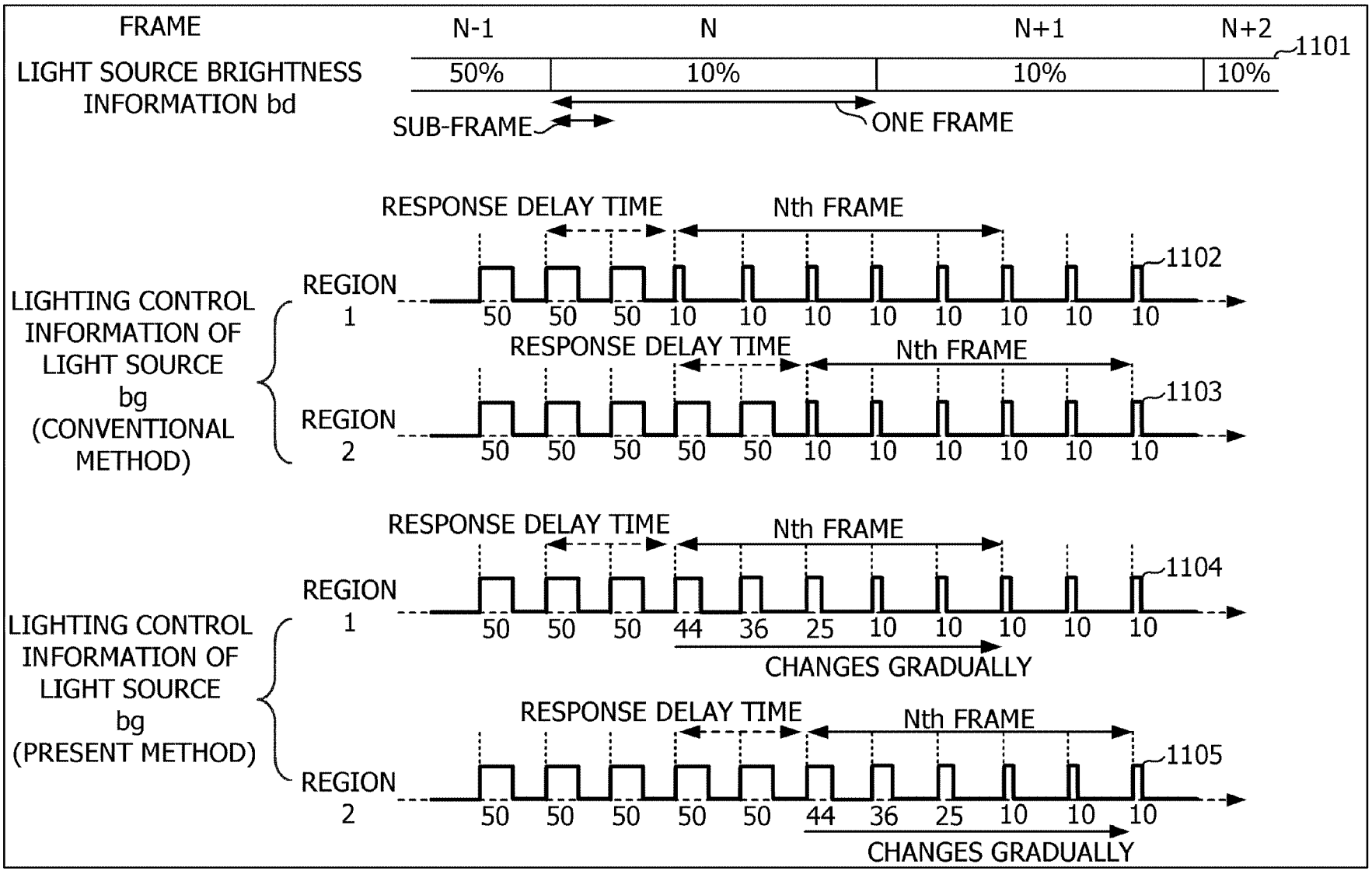
FIG. 11 is a diagram depicting an example of light source control information according to a conventional method and the first embodiment.

FIG. 11 is a diagram depicting an example of light source control information according to the conventional method and the first embodiment. In FIG. 11, the light source brightness information bd (0 to 100%) in the N−1th frame is 50%, and the light source brightness information bd in the N to N+2th frames is 10%. The signals 1102 and 1103 indicate the lighting control information bg of the light source according to the conventional method. The signals 1104 and 1105 indicate the lighting control information bg of the light source according to the first embodiment. Both cases are examples when the response delay time of the liquid crystal panel is 0.4.

The signals 1102 and 1103 are signals when the sub-frame lighting control is performed at 10% light source brightness information bd, which corresponds to the light source brightness information bd in the Nth frame in the sub-frame (SN=3) after the response delay time. The signals 1104 and 1105, on the other hand, are lighting control information for each sub-frame according to the first embodiment. In the example of FIG. 11, the lighting control is performed so that the signals 1104 and 1105 in the Nth frame change more gradually than linear change. Specifically, in the signals 1104 and 1105, the lighting in the sub-frames (SN=1 to 5) in the Nth frame is 44→36→25→10→10%. The user less visually recognizes the leakage light, since the change amount between sub-frames is gradually increasing. In other words, as mentioned above, even if the leakage light quantity difference between controls areas is large, flicker is suppressed by gradually changing the luminescence intensity of the light source.

Application Example 3

An application example of performing the lighting control of the light source (increasing brightness), when a number of sub-frames is 5, will be described with reference to FIG. 12.

Figure 12:
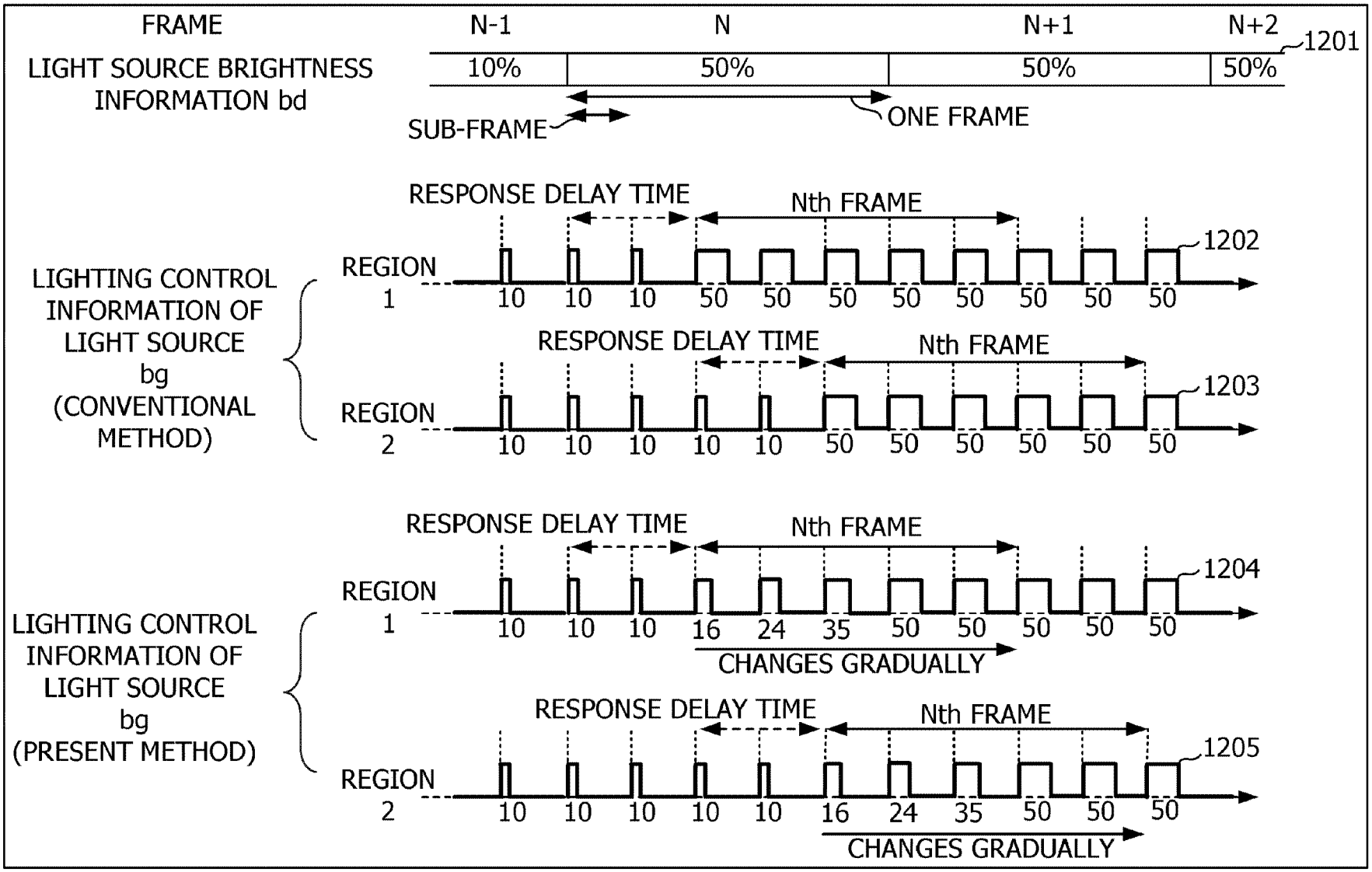
FIG. 12 is a diagram depicting an example of light source control information according to a conventional method and the first embodiment.

FIG. 12 is a diagram depicting an example of the light source control information according to the conventional method and the first embodiment. In FIG. 12, the light source brightness information bd (0 to 100%) in the N−1th frame is 10%, and the light source brightness information bd in the N to N+2th frame is 50%. The signals 1202 and 1203 indicate the lighting control information bg of the light source according to the conventional method. The signals 1204 and 1205 indicate the lighting control information bg of the light source according to the first embodiment. Both cases are examples when the response delay time of the liquid crystal panel is 0.4.

The signals 1202 and 1203 are signals when the sub-frame lighting control is performed at 50% light source brightness information bd, which corresponds to the light source brightness information bd in the Nth frame in the sub-frame (SN=3) after the response delay time. The signals 1204 and 1205, on the other hand, are lighting control information for each sub-frame according to the first embodiment. In the example of FIG. 12, the lighting control is performed so that the signals 1204 and 1205 in the Nth frame change more gradually than linear change. Specifically, in the signals 1204 and 1205, the lighting in the sub-frames (SN=1 to 5) in the Nth frame is 16→24→35→50→50%. The user less visually recognizes the leakage light since the change amount between sub-frames is gradually increasing. In other words, as mentioned above, even if the leakage light quantity difference between control areas is large, flicker is suppressed by gradually changing the luminescence intensity of the light source.

Functional Effect of the First Embodiment

As mentioned above, the liquid crystal response detecting unit 106 calculates the transmittance change caused by the response delay of the liquid crystals for each sub-frame. Then the light quantity change detecting unit 107 calculates the light source control changing amount for each sub-frame. The leakage light quantity is calculated based on the transmittance change amount and the light source control change amount for each sub-frame, and the processing to determine the light quantity control value to reduce the leakage light quantity in each sub-frame is performed. By this control, the leakage light quantity in each sub-frame decreases, and flicker can be suppressed. Therefore, flicker can also be suppressed using the display apparatus, by performing control to change the brightness of the light source and the display unit in accordance with the image.

<Modification>

In the first embodiment, it was described that the light source control in the sub-frame period is performed based on the leakage light quantity in each region of one frame period. This is an effective control method in the GD control, where the light sources in the entire screen are all changed in the same way. However, in the case of the LD control, the brightness increase/decrease and the change amount of the light source are different depending on the control area. In this case, the leakage light quantity difference is detected for each sub-frame period, and the light source control in the sub-frame period is controlled based on the leakage light quantity difference, then the leakage light quantity can be further reduced.

In the first embodiment, the control of reducing the leakage light quantity, using only one type of table data of the response information TBL 105, was described. However, the response speed of the liquid crystal panel changes in accordance with the driving frequency and the frequency of the input video signal, hence the table data of the response information TBL 105 may be provided for each driving frequency, and appropriate table data may be selected and used. By this control, the leakage light quantity can be reduced for each driving frequency of the liquid crystal panel, and flicker can be suppressed even more.

In the first embodiment, an example of the light quantity determination unit 110, controlling to decrease the leakage light quantity difference (maximum leakage light quantity− minimum leakage light quantity) in each control, was described. However, even if the leakage light quantity difference between control areas is small, the entire screen looks as if flickering if the level of the generated leakage light quantity is high. Therefore, the light quantity determination unit 110 may detect the control area in which the leakage light quantity is at least a predetermined threshold, and if a leakage light quantity that is at least the predetermined threshold exists, the light sources of the entire screen may be controlled so as to reduce the leakage light quantity in this control area. By controlling this way, the leakage light quantity in the entire screen is reduced, and flicker in the entire screen can be suppressed. The light quantity determination unit 110 may detect a control area in which the leakage light quantity is at maximum, and control the light sources of the entire screen so as to reduce the leakage light quantity in this control area.

In the first embodiment, an example of gradually changing the lighting control information between sub-frames was described, but a target brightness of each light source may be set. In concrete terms, the target brightness of each light source is set based on the brightness of the target frame, and the light quantity determination unit 110 controls the light emission brightness of each light source in the sub-frame period of the target frame period in the range of the light emission brightness of each light source and the target brightness in the final sub-frame of the previous frame period. For example, if the target frame is brighter than the previous frame, the light quantity determination unit 110 may control the light emission brightness in the sub-frame period of the target frame period in the range from the light emission brightness in the final sub-frame of the previous frame period to the target brightness.

Second Embodiment

A second embodiment of the present invention will be described.

<Overview>

In the first embodiment, the leakage light quantity detecting unit 109 detects the leakage light quantity based on the brightness information of the light source and liquid crystal response information, and the light quantity determination unit 110 controls the light quantity in the sub-frame period of the light emission unit, so as to suppress flicker. A difference of the second embodiment from the first embodiment is that the light quantity of the light source is controlled based on the change of the brightness information of the light source. In the following, the configurations and processing that are different from the first embodiment will be described in detail, and the configurations and processing the same as the first embodiment are denoted with the same reference numbers, and description thereof is omitted.

<General Configuration>

Figure 13:
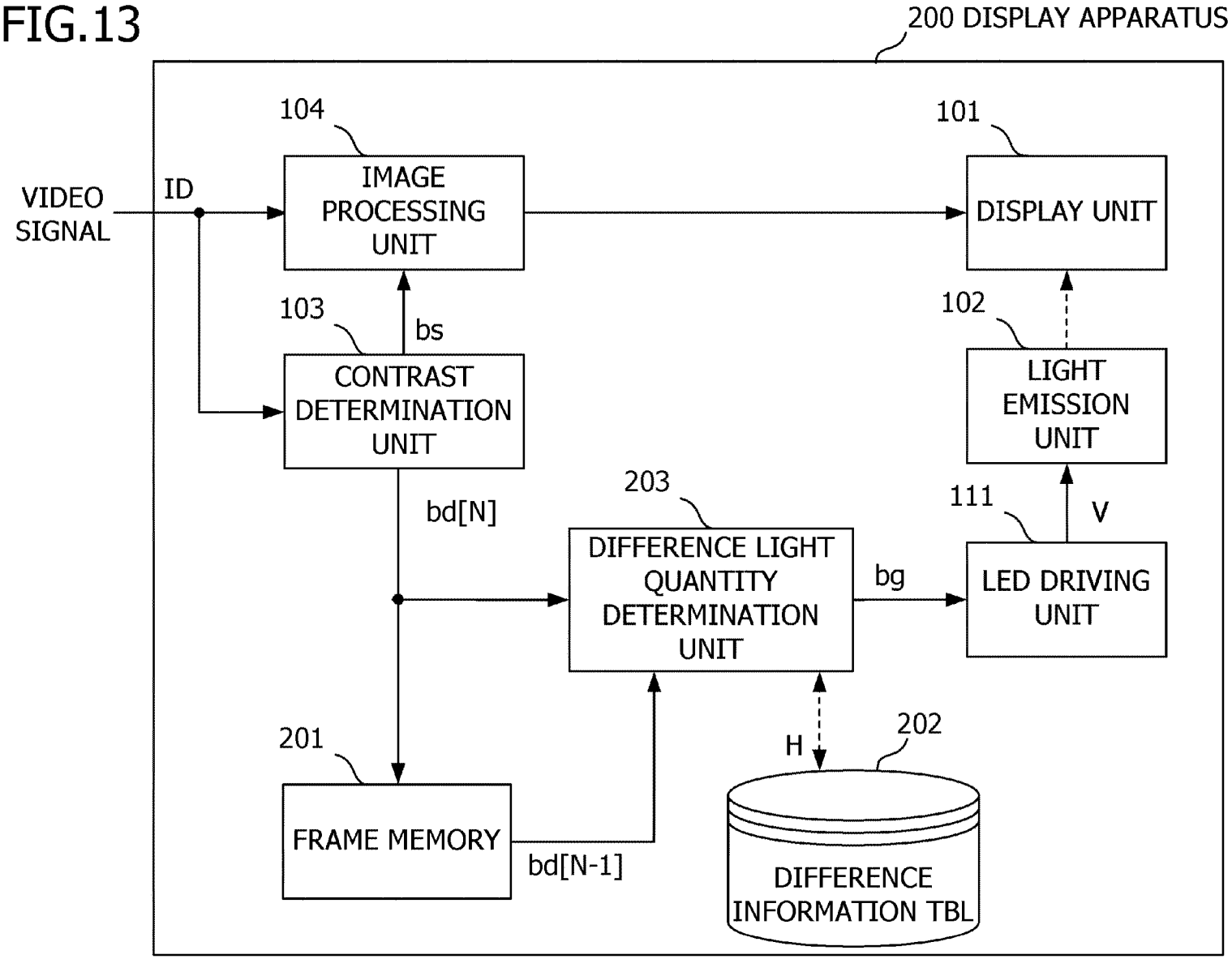
FIG. 13 is a functional block diagram depicting an example of a display apparatus according to a second embodiment.

FIG. 13 is a functional block diagram depicting an example of a display apparatus 200 according to the second embodiment. The display apparatus 200 is an information processing apparatus (computer) which includes: an arithmetic unit (processor), a memory, a storage device and an input/output device. By the display apparatus 200 executing programs stored in the storage device, the functions of the display unit 101, the light emission unit 102, the contrast determination unit 103, the image processing unit 104 and the LED driving unit 111 of the display apparatus 200 are provided. Further, in the second embodiment, by the display apparatus 200 executing the programs stored in the storage device, the functions of a frame memory 201, a difference information TBL 202 and a difference light quantity determination unit 203 of the display apparatus 200 are provided. A part or all of these functions may be implemented by dedicated logic circuits, such as ASIC and FPGA.

The frame memory 201 temporarily stores the light source brightness information bd (bd [N]) that is output from the contrast determination unit 103 for each frame, and outputs the light source brightness information bd, which is delayed by one frame (bd [N−1]) to the difference light quantity determination unit 203.

The difference information TBL 202 is a gain information table H (LUT) that stores the control gain information in the sub-frame period, in which the leakage light quantity is reduced based on the change amount of the light source brightness information bd. FIG. 14A and FIG. 14B are tables of the control gain table data structure. The column of FIG. 14A and FIG. 14B indicates the light source brightness information of the current frame, and the row indicates the light source brightness information of the previous frame. Further, FIG. 14A and FIG. 14B store the control gain value for each sub-frame number.

For the gain information table H, the data can be created in advance using a measuring instrument or the like. The table data in FIG. 14A and FIG. 14B is normalized brightness correction gain values in the sub-frame period in which the leakage light can be reduced, based on the relationship between the light source brightness information of the current frame and the light source brightness information of the previous frame. When the row number and the column number, to indicate the position of the control area in which the light is emitted, are n, n, and the sub-frame number is SN, the control gain value in the sub-frame, of which sub-frame number is SN at the row m and column n, is $H_{m,n}$ [SN].

The difference light quantity determination unit 203 determines the light source control information bg in the sub-frame period based on the control gain H in the difference information TBL 202, the light source brightness information bd from the contrast determination unit 103, that is, based on the leakage light quantity and the light source brightness information. For the calculation, Expression (15) is used.

$$bg_{m,n}[\mathrm{SN}]=\{bd_{m,n}[N-1]-bd_{m,n}[N]\}\times H_{m,n}[\mathrm{SN}]+bd_{m,n}[N-1] \quad (15)$$

In this way, the leakage light quantity can be reduced by controlling light quantity of the light sources in the sub-frame using the control gain value, based on the change amount of the light source brightness information bd. In other words, the flicker can be suppressed as in the first embodiment by reducing the leakage light quantity.

Functional Effect of the Second Embodiment

As described above, according to the second embodiment, the difference light quantity determination unit 203 controls the light quantity of the light sources in each sub-frame based on the light source brightness information bd which changes depending on the frame, so that the leakage light quantity is not generated. Since the leakage light quantity is reduced by controlling the light source brightness for each sub-frame, flicker can be suppressed.

<Modification>

In the second embodiment, an example of performing the light source control in the sub-frame period based on the difference information TBL was described. However, the table data structure of the difference information TBL may be mathematically expressed and used for control calculation. For example, a control gain H may be calculated based on the difference information of the light source brightness information bd which changes for each frame, and the above Expression (15) is used, whereby a control to reduce the leakage light quantity can be performed.

As described in the first embodiment, the response speed of liquid crystals is normally slow, which is about 8 ms (about half of one frame period). Hence, in the case of performing the sub-frame light emission of the light source, the leakage light is reduced by gradually changing the light quantity of the light source. In other words, the leakage light quantity can be reduced by calculating the control gain H which exponentially changes the change amount of the light source. In particular, when the light quantity of the light sources and the display gradation are changed uniformly in-plane, as in the case of the GD control, even such a simple detection and control can implement an effect to suppress flicker.

OTHER EMBODIMENTS

In the description of the above embodiments, the display control device is included in the display apparatus as an example, but the above-mentioned processing may be performed using only a display control device which is disposed separately from the display apparatus.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-056396, filed on Mar. 23, 2018, which is hereby incorporated by reference herein in its entirety.

What is claimed is:

1. A display apparatus comprising:

a light emission unit including a plurality of light sources that emit light;

a display unit configured to display an image by transmitting the light on the basis of frames;

at least one processor which function as a determination unit configured to determine a luminescence intensity of each of the light sources for each sub-frame; and a control unit configured to control lighting of each of the light sources for each sub-frame at the luminescence intensity determined by the determination unit, wherein the determination unit is further configured to increase the change of the luminescence intensity of each light source for each sub-frame so that the difference of a leakage light quantity between regions of the display unit is reduced, the leakage light quantity being a transmission quantity of light from other light sources that is generated due to response delay in transmission by the display unit, when the frame changes, a transmittance of the display unit gradually changes by the response delay, the display unit displays the image by a driving method in which display in a second area is delayed with respect to display in a first area, and the determination unit is further configured to increase the change of the luminescence intensity of each light source for each sub-frame so that the difference between a first leakage light quantity and a second leakage light quantity, the first leakage light quantity being a transmission quantity in the first area of light emitted from a second light source corresponding to the second area during a first period in which a transmittance in the first area gradually changes, the second leakage light quantity being a transmission quantity in the second area of light emitted from a first light source corresponding to the first area during a second period in which a transmittance in the second area gradually changes, and the difference is generated due to the response delay and the driving method of the display unit.

2. The display apparatus according to claim 1, wherein in a case where a maximum value of the difference of the leakage light quantity between the regions is at least a first threshold, the determination unit is further configured to determine the luminescence intensity for each sub-frame so that an in-plane difference of the leakage light quantity decreases, and in a case where the maximum value of the difference of the leakage light quantity between the regions is less than the first threshold, the determination unit is further configured to determine the luminescence intensity on the basis of a current frame.

3. The display apparatus according to claim 1, wherein the leakage light quantity is determined on the basis of a quantity of diffused light that is irradiated from other light sources to the region of the display apparatus corresponding to the light source.

4. The display apparatus according to claim 3, wherein the diffused light quantity is determined on the basis of a change amount of brightness information for each of the regions, wherein the brightness information is based on an input frame.

5. The display apparatus according to claim 3, wherein the display unit is a liquid crystal panel which transmits the light on the basis of an input frame, and the leakage light quantity is determined on the basis of a transmittance change amount, that is a ratio of the diffused light quantity transmitted through the region during a response delay time of the liquid crystal panel.

6. The display apparatus according to claim 5, wherein the transmittance change amount is determined, on the basis of pixel values of image data and a response characteristic of the liquid crystal panel.

7. The display apparatus according to claim 1, wherein the determination unit is further configured to determine the luminescence intensity on the basis of (1) image data of a previous frame, (2) image data of a current frame, and (3) LUT that is generated for each sub-frame considering a response characteristic.

8. The display apparatus according to claim 1, wherein the determination unit is further configured to determine the luminescence intensity considering a driving frequency of the display unit as well.

9. A control method of a display apparatus, wherein the display apparatus comprising (1) a light emission unit including a plurality of light sources that emit light, and (2) a display unit configured to display an image by transmitting the light on the basis of frames, the control method comprising:

determining a luminescence intensity of each of the light sources for each sub-frame; and controlling lighting of each of the light sources for each sub-frame at the luminescence intensity, wherein in the determining, the change of the luminescence intensity of each light source for each sub-frame is increased so that the difference of a leakage light quantity between regions of the display unit is reduced, the leakage light quantity being a transmission quantity of light from other light sources that is generated due to response delay in transmission by the display unit, when the frame changes, a transmittance of the display unit gradually changes by the response delay, the display unit displays the image by a driving method in which display in a second area is delayed with respect to display in a first area, and in the determining, the change of the luminescence intensity of each light source for each sub-frame is increased so that the difference between a first leakage light quantity and a second leakage light quantity, the first leakage light quantity being a transmission quantity in the first area of light emitted from a second light source corresponding to the second area during a first period in which a transmittance in the first area gradually changes, the second leakage light quantity being a transmission quantity in the second area of light emitted from a first light source corresponding to the first area during a second period in which a transmittance in the second area gradually changes, and the difference is generated due to the response delay and the driving method of the display unit.

10. The control method of a display apparatus according to claim 9, wherein in a case where a maximum value of the difference of the leakage light quantity between the regions is at least a first threshold, in the determining, the luminescence intensity is determined for each sub-frame so that an in-plane difference of the leakage light quantity decreases, and in a case where the maximum value of the difference of the leakage light quantity between the regions is less than the first threshold, in the determining, the luminescence intensity is determined on the basis of a current frame.

11. The control method of a display apparatus according to claim 9, wherein the leakage light quantity is determined on the basis of a quantity of diffused light that is irradiated from other light sources to the region of the display apparatus corresponding to the light source.

12. The control method of a display apparatus according to claim 11, wherein the diffused light quantity is determined on the basis of a change amount of brightness information for each of the regions, wherein the brightness information is based on an input frame.

13. The control method of a display apparatus according to claim 11, wherein the display unit is a liquid crystal panel which transmits the light on the basis of an input frame, and the leakage light quantity is determined on the basis of a transmittance change amount, that is a ratio of the diffused light quantity transmitted through the region during a response delay time of the liquid crystal panel.

14. The control method of a display apparatus according to claim 13, wherein the transmittance change amount is determined, on the basis of pixel values of image data and a response characteristic of the liquid crystal panel.

15. The control method of a display apparatus according to claim 9, wherein in the determining, the luminescence intensity is determined on the basis of (1) image data of a previous frame, (2) image data of a current frame, and (3) LUT that is generated for each sub-frame considering a response characteristic.

16. The control method of a display apparatus according to claim 9, wherein in the determining, the luminescence intensity is determined considering a driving frequency of the display unit as well.

17. A non-transitory computer readable medium that stores a program, wherein the program causes a computer to execute: a control method of a display apparatus, wherein the display apparatus comprising (1) a light emission unit including a plurality of light sources that emit light, and (2) a display unit configured to display an image by transmitting the light on the basis of frames, the control method comprising:

determining a luminescence intensity of each of the light sources for each sub-frame; and controlling lighting of each of the light sources for each sub-frame at the luminescence intensity, wherein in the determining, the change of the luminescence intensity of each light source for each sub-frame is increased so that the difference of a leakage light quantity between regions of the display unit is reduced, the leakage light quantity being a transmission quantity of light from other light sources that is generated due to response delay in transmission by the display unit, when the frame changes, a transmittance of the display unit gradually changes by the response delay, the display unit displays the image by a driving method in which display in a second area is delayed with respect to display in a first area, and in the determining, the change of the luminescence intensity of each light source for each sub-frame is increased so that the difference between a first leakage light quantity and a second leakage light quantity, the first leakage light quantity being a transmission quantity in the first area of light emitted from a second light source corresponding to the second area during a first period in which a transmittance in the first area gradually changes, the second leakage light quantity being a transmission quantity in the second area of light emitted from a first light source corresponding to the first area during a second period in which a transmittance in the second area gradually changes, and the difference is generated due to the response delay and the driving method of the display unit.

18. The display apparatus according to claim 1, wherein the control unit controls the lighting of each of the light sources by a control method in which after the transmittance of the display unit changes to a transmittance corresponding to the frame, lighting corresponding to this frame is performed, and the difference between the first leakage light quantity and the second leakage light quantity is generated due to the response delay of the display unit, the driving method of the display unit, and the control method of the control unit.

* * * * *